US006273719B1

(12) United States Patent
Whitman

(10) Patent No.: US 6,273,719 B1
(45) Date of Patent: Aug. 14, 2001

(54) ORAL HYGIENE IMPLEMENTS

(76) Inventor: Nathan Lee Whitman, 124A Tung Lo Wan Road, Causeway Bay (HK)

( * ) Notice: Subject to any disclaimer, the term of this patent is extended or adjusted under 35 U.S.C. 154(b) by 0 days.

(21) Appl. No.: 09/571,469

(22) Filed: May 16, 2000

(30) Foreign Application Priority Data

May 18, 1999 (GB) ..... 9911419

(51) Int. Cl.[7] ..... A61C 3/00
(52) U.S. Cl. ..... 433/141; 15/167.1
(58) Field of Search ..... 433/141, 142, 433/143, 147; 15/167.1, 110

(56) References Cited

U.S. PATENT DOCUMENTS

| | | | | |
|---|---|---|---|---|
| D. 407,560 | | 4/1999 | Huang . | |
| D. 414,608 | | 10/1999 | Trojanowski et al. . | |
| 3,959,842 | * | 6/1976 | Alley | 433/141 X |
| 4,356,585 | | 11/1982 | Protell et al. . | |
| 5,005,246 | | 4/1991 | Yen-Hui . | |
| 5,709,004 | | 1/1998 | Paduano . | |
| 5,779,475 | * | 7/1998 | Patel | 433/141 |
| 5,781,958 | * | 7/1998 | Meessmann et al. | 433/141 X |

FOREIGN PATENT DOCUMENTS

29819064 U 2/1999 (DE) .

* cited by examiner

*Primary Examiner*—Nicholas D. Lucchesi
(74) *Attorney, Agent, or Firm*—Mark P. Stone

(57) ABSTRACT

An oral hygiene implement comprises: an elongate handle having first and second opposite ends; a brush head formed at the first end of the handle and suitable for cleaning the teeth; and a continuous loop integrally formed with the handle at the second end of the handle and having an edge suitable for scraping the tongue. The implement can be held by the handle and the brush head can be placed in the mouth so that the implement can be used as a toothbrush. Alternatively, the implement can be held by the handle and the loop can be placed in the mouth so that the implement can be used as a tongue strigil.

4 Claims, 2 Drawing Sheets

ORAL HYGIENE IMPLEMENTS

BACKGROUND OF THE INVENTION

1. Field of the Invention

This invention relates to oral hygiene implements.

Most people clean their teeth often, even if not as often or for as long as dentists recommend.

Although practised to some extent nowadays, but not widely, cleansing of the tongue has been practised for thousands of years, at least as far back as the Egyptians, who realised the importance of a clean tongue. The surface of the tongue has sensory taste receptor cells, or taste buds, which determine how bitter, salty, sweet or sour things that we consume taste. Undisturbed saliva, bacteria and food debris in the mouth eventually turn into plaque. Once plaque has formed, it causes tooth decay, gum disease and halitosis, or bad breath. A build-up of plaque on the tongue's taste buds can result in them not functioning fully and a loss of taste sensitivity. Smoking has a similar effect. No matter how often somebody cleans their teeth, a coating of plaque, food debris, etc. remains on their tongue unless it is also removed.

2. Description of the Prior Art

Strigils are known for scraping the tongue to remove the coating thereon. It is also known to provide a combined tongue strigil and toothbrush. In this connection, patent document DE 29819064U 1 shows a toothbrush having a scraping edge along a corner of the cross-section of its handle. A disadvantage of this is that the scraping edge will tend to cut into the user's fingers or thumb, or at least be uncomfortable, when the device is being used as a toothbrush. To deal with this problem, patent document U.S. Pat. No. 5,005,246 describes a toothbrush with a tongue scaler which can be extended, when required, from a channel within the toothbrush handle and which has an edge for scraping the tongue. Disadvantages of this are that the device is complicated and the channel inside the toothbrush handle provides a hiding place for bacteria and other matter removed from the tongue. Furthermore, patent document U.S. Pat. No. 4,356,585 describes a toothbrush with a spoon-like formation part-way along its handle. Part of the rim of this formation is intended to be used for scraping the tongue. A disadvantage of all three of these known devices is that they either cannot be used, or can only be used with great difficulty, to scrape the rear of the tongue. Also, patent document U.S. Pat. No. 5,709,004 describes a combined toothbrush and tongue scraper which is formed generally like a pair of tongs. The end of each tong is provided with half of the toothbrush head and the tongs can be clipped together for use as a toothbrush. When the tongs are unclipped, each tong is used as a handle, and the part of the device joining the tongs forms the tongue scraper. Disadvantages of this device are that it is of complicated construction, and bacteria and other matter removed from the tongue can collect between the tongs and in the elements used for clipping the tongs together.

SUMMARY OF THE INVENTION

Objects of the present invention, or at least specific embodiments of it, are: to provide a toothbrush which is adapted also to be usable as a tongue strigil or scraper so as to encourage people to clean their tongues regularly; to provide such an implement which is of simple and inexpensive construction; to provide such an implement which does not provide a hiding place for bacteria and other matter removed from the user's tongue; and to provide such an implement which can be used without difficulty to scrape the rear of the user's tongue.

In accordance with a first aspect of the present invention, there is provided an oral hygiene implement comprising: an elongate handle; a brush head formed at one end of the handle and suitable for cleaning the teeth; and a continuous loop integrally formed with the handle at the other end of the handle. The loop has an edge, suitable for scraping the tongue, which may extend around at least a major part of the loop. The implement can be held by the handle and the brush head can be placed in the mouth so that the implement can be used as a toothbrush. Alternatively, the implement can be held by the handle and the loop can be placed in the mouth so that the implement can be used as a tongue strigil. Because the scraping edge is formed near one end of the implement, it can be used to clean the rear of the tongue. Because the scraping edge is formed on the continuous loop, there is no need for a special handle which is split along its length, and so a simple construction can be used which does not provide a hiding place for bacteria and other matter.

Preferably, the brush head and the scraping edge face in generally opposite directions.

Preferably, the loop is inclined slightly relative to the longitudinal axis, for example at between 20° and 45°, and more preferably between 30° to 40°. This enables the user, with a mirror, more easily to see their tongue as the scraping process proceeds.

Preferably, the handle has a neck between its mid portion and the brush head and another neck between its mid portion and the loop.

In accordance with a second aspect of the present invention, there is provided an oral hygiene implement, comprising: a brush head suitable for brushing teeth; and a stem extending from the brush head to a distal end of the stern, the stem being formed part-way along its length with at least one surface formation suitable for scraping the tongue; whereby: the stem can be held by one hand and the implement can be used as a toothbrush; and alternatively the distal end of the stem and the brush head can be held by both hands and the implement can be used a tongue strigil.

DETAILED DESCRIPTION OF THE PREFERRED EMBODIMENTS

Specific embodiments of the present invention will now be described, purely by way of example, with reference to the accompanying drawings.

Figure 1:
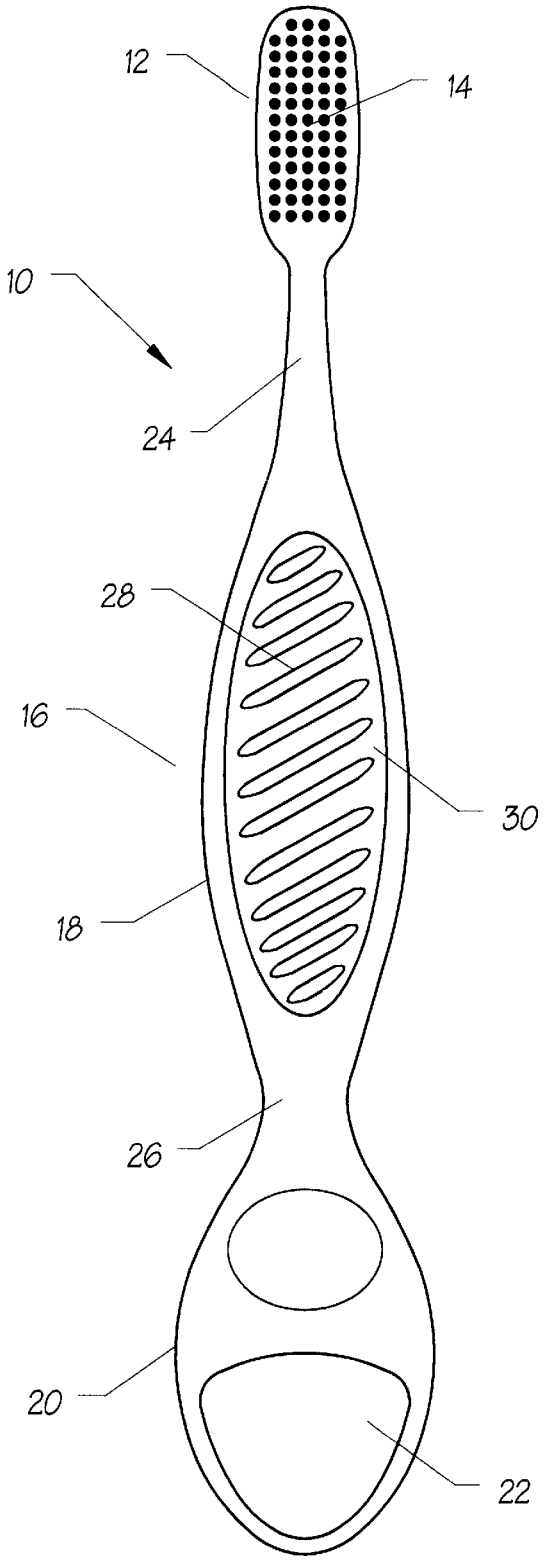
FIG. 1 is a front view of one embodiment of an implement which is a combined toothbrush and tongue strigil.
Figure 2:
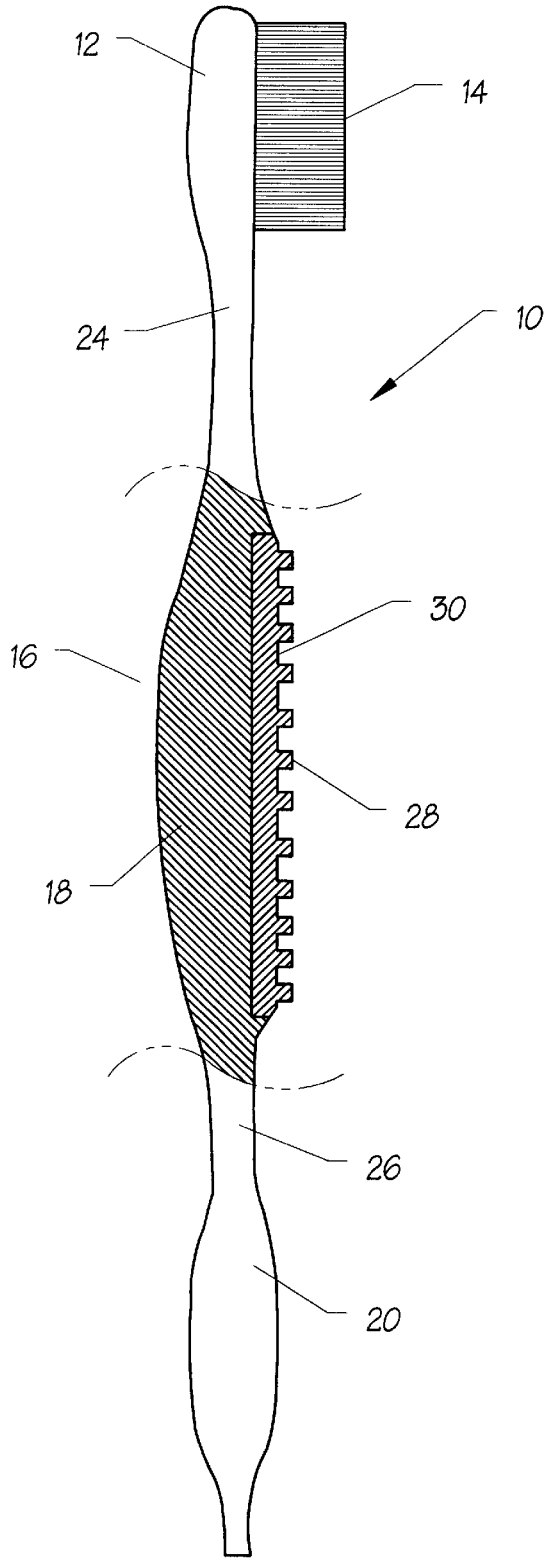
FIG. 2 is a side view of the implement of FIG. 1, partly sectioned.

Referring to the FIGS. 1 and 2, the implement 10 of the first embodiment of the invention is similar to a conventional toothbrush, having a brush head 12 with bristles 14, and a handle 16, except that:

- a mid-portion 18 of the handle 16 is widened and thickened;
- the distal end 20 of the handle 16 is widened and has a relatively large through-hole 22;

a neck 24 is formed between the brush head 12 and the mid-portion 18 of the handle 16;

a neck 26 is formed between the mid-portion 18 of the handle 16 and its distal end 20; and inclined ridges 28, for scraping the tongue, are formed on the mid-portion 18 of the handle 16, facing in the same direction as the bristles on the brush head.

It will therefore be appreciated that the implement 10 may be used as a toothbrush in the conventional way, with the user holding the handle 16 in one hand, and may also be used as a tongue strigil, with the user holding the brush head 12 in one hand and the distal end 20 of the handle 16 in the other hand, and drawing the ridges 28 across their tongue to scrape-off plaque, food debris, etc. from the tongue.

The handle 16 may be manufactured of any suitable conventional material, for example a plastics material. The ridges may be integrally formed with the handle 16, or they may be provided as part of a separate element 30 which is secured in a recess in the handle 16. In this latter case, the element 30 may be of a different material to the handle 16, for example a different type of plastics material, rubber or metal.

It will be appreciated that many modifications and developments may be made to the implement described with reference to FIGS. 1 and 2. For example, surface formations other than the ridges 28 may be used.

Figure 3:
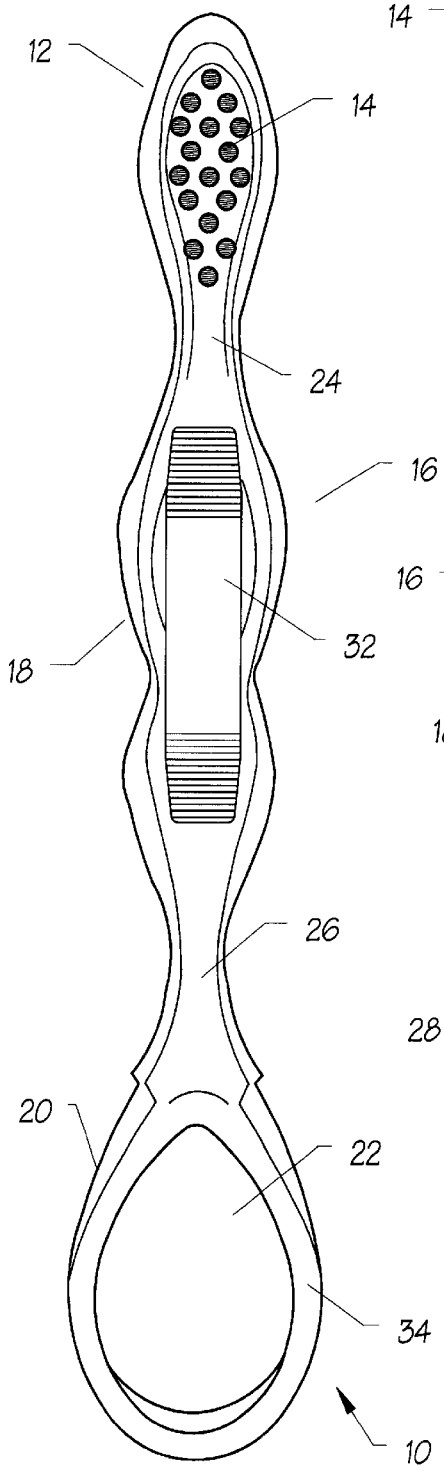
FIG. 3 is a front view of another embodiment of such an implement.
Figure 4:
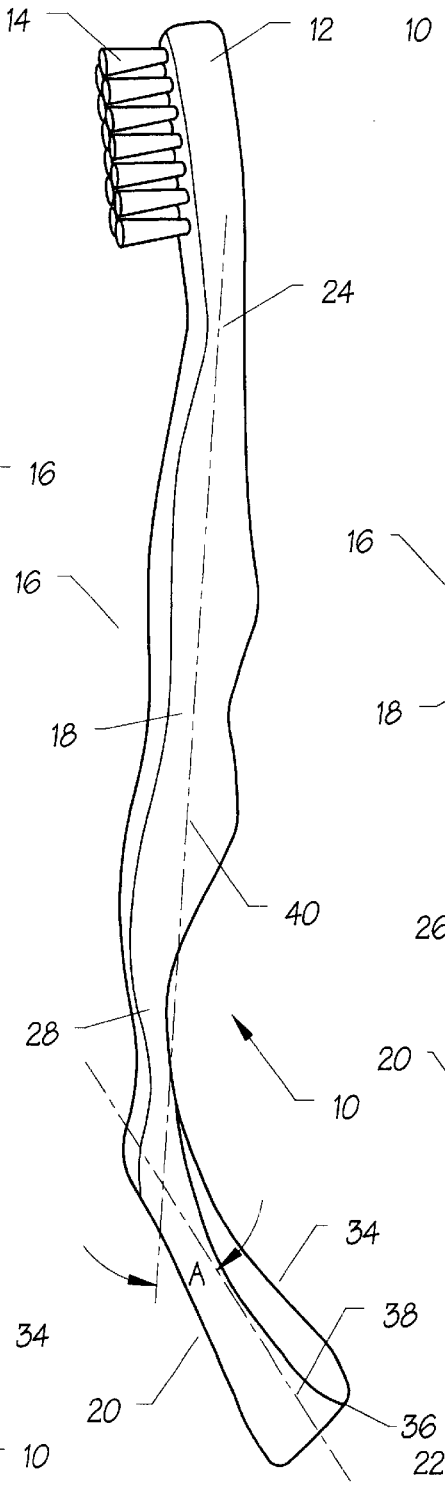
FIG. 4 is a side view of the implement of FIG. 3.
Figure 5:
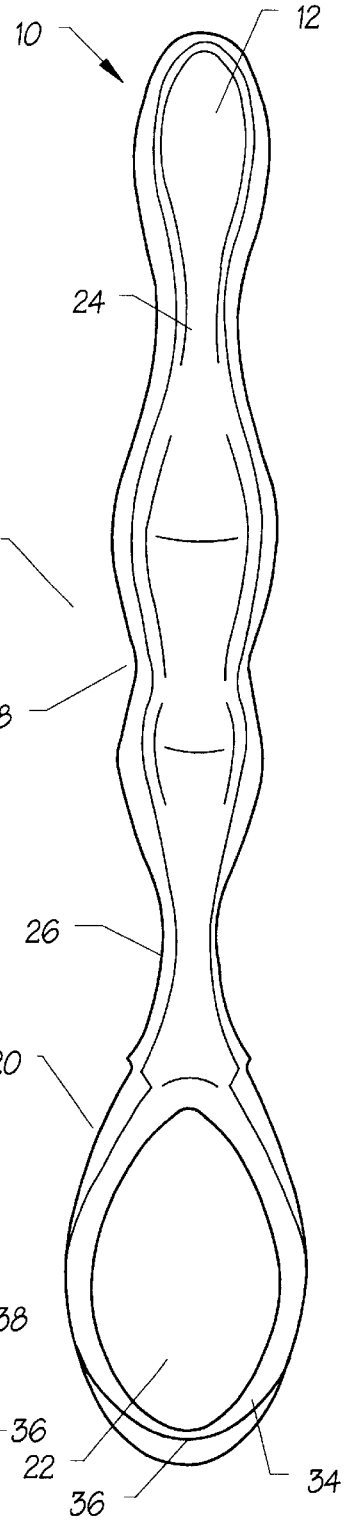
FIG. 5 is a rear view of the implement of FIG. 3.

The second embodiment of the invention will now be described with reference to FIGS. 3 to 5 in which features similar to those described above with reference to FIGS. 1 and 2 are denoted with like reference numerals. By contrast to the first embodiment, in the second embodiment the tongue scraping portion is not provided on the mid-portion 18 of the handle 16, although the mid-portion 18 may be provided with a feature 32, such as a label or a region to provide increased grip when the implement 10 is being used. Instead, the tongue scraping portion is provided at the distal end 20 of the handle 16. More particularly, the loop 34 around the hole 22 is provided with an edge 36 which extends around at least a major portion of the loop and which can be used to scrape the tongue. The edge 36 is relatively sharp, but not so sharp that there is a risk of cutting the tongue in normal use. The edge 36 is provided on the side of the loop 34 which faces generally in the opposite direction to the bristles 14 on the brush head 12. Therefore, in order to scrape the upper surface of their tongue, the user holds the mid-portion 18 of the handle 16 in their hand and inserts the distal end 20 of the implement 10 into their mouth with the edge 36 facing generally downwardly and the bristles 14 facing generally downwardly. The edge 36 is then drawn across the upper surface of the tongue so as to scrape plaque, food debris, etc therefrom. As shown in the side view of FIG. 4, the plane 38 generally through the loop 34 is inclined at an angle A which is between about 20° and 45°, and preferably between about 30° to 40°, with respect to the plane 40 generally through the mid-portion 18 of the handle 16. As a result, and by contrast to the case where the loop 34 is generally aligned with the mid-portion 18 of the handle 16, the downward inclination of the mid-portion 18 in use enables the user, with a mirror, more easily to see their tongue as the scraping process proceeds.

It will be appreciated that many modifications and developments may be made to the embodiments of the invention described above. For example, because the implement may not fit into a conventional toothbrush holder, the implement may be provided with a clip which fits the handle 16 and which can be affixed to a wall. Alternatively, the implement may be hung on a peg or the like by its loop 34.

It should be noted that the embodiments of the invention have been described above purely by way of example and that many other modifications and developments may be made thereto within the scope of the present invention.

What I claim is:

1. An oral hygiene implement comprising: an elongate handle having a generally longitudinal axis and first and second opposite ends; a brush head formed at the first end of the handle and suitable for cleaning the teeth; and a continuous loop integrally formed with the handle at the second end of the handle; wherein: the loop lies in a general plane that is inclined at an angle in the range of 20 degrees to 45 degrees relative to the longitudinal axis of the handle; the loop has an unserrated scraping edge that extends around at least a major portion of the loop and which, when the loop is placed on a user's tongue with the handle projection outwardly and downwardly from the user's mouth, engages with and is suitable for scraping the tongue; and wherein: the implement can be used as a toothbrush; and the implement can be held by the handle and the loop can be placed in the user's mouth so that the implement can be used as a tongue strigil with the handle projecting outwardly and downwardly from the user's mouth.

2. An implement as claimed in claim 1, wherein: the brush head faces generally in one direction relative to the handle; and the scraping edge faces generally in the opposite direction.

3. An implement as claimed in claim 1, wherein the loop has an angle of inclination relative to the handle axis in the range of 30° to 40°.

4. An implement as claimed in claim 1, wherein the handle has a mid portion, a first neck between the mid portion and the brush head, and a second neck between the mid portion and the loop.

* * * * *